United States Patent [19]

Arahara et al.

[11] Patent Number: 5,004,667

[45] Date of Patent: Apr. 2, 1991

[54] PHOTOSENSITIVE MATERIAL, AND IMAGE FORMATION PROCESS AND IMAGE FORMATION APPARATUS USING SAME

[75] Inventors: Kozo Arahara; Tetsuro Fukui; Hiroshi Fukumoto, all of Kawasaki; Masato Katayama, Yokohama; Yoshio Takasu, Tama, all of Japan

[73] Assignee: Canon Kabushiki Kaisha, Tokyo, Japan

[21] Appl. No.: 281,757

[22] Filed: Dec. 9, 1988

[30] Foreign Application Priority Data

Dec. 15, 1987 [JP] Japan ..... 62-317116

[51] Int. Cl.[5] ..... G03C 11/12

[52] U.S. Cl. ..... 430/255; 430/254; 430/270; 430/330; 430/271; 250/318

[58] Field of Search ..... 430/254, 255, 902, 270, 430/271, 40, 41, 48, 330; 355/3 TE, 217; 250/318

[56] References Cited

U.S. PATENT DOCUMENTS

| | | | |
|---|---|---|---|
| 3,353,955 | 11/1967 | Colgrove | 430/255 |
| 3,487,764 | 1/1970 | Borden et al. | 430/254 |
| 3,909,257 | 9/1975 | Davidson | 430/40 |
| 3,912,504 | 10/1975 | Kropac | 430/40 |
| 4,108,655 | 8/1978 | Kropac | 430/40 |
| 4,210,711 | 7/1980 | Kitajima et al. | 430/253 |
| 4,272,608 | 6/1981 | Proskow | 430/288 |
| 4,334,006 | 6/1982 | Kitaima et al. | 430/254 |
| 4,396,700 | 8/1983 | Kitaima et al. | 430/254 |
| 4,558,003 | 12/1985 | Sagawa | 430/617 |
| 4,620,096 | 10/1986 | Takehara et al. | 250/318 |
| 4,629,676 | 12/1986 | Hayakawa et al. | 430/254 |
| 4,737,822 | 4/1988 | Taniguchi et al. | 250/318 |
| 4,764,451 | 8/1988 | Ishikawa | 430/138 |
| 4,800,275 | 1/1989 | Shimizu et al. | 250/318 |
| 4,822,717 | 4/1989 | Nakamura | 430/254 |
| 4,825,074 | 4/1989 | Yoshikawa | 250/318 |

*Primary Examiner*—Marion E. McCamish
*Assistant Examiner*—Christopher D. RoDee
*Attorney, Agent, or Firm*—Fitzpatrick, Cella, Harper & Scinto

[57] ABSTRACT

A photosensitive material and comprises a photosensitive and heat-developable element and a polymer, and is capable of being endowed with stickness by a change of pH value or being subjected to exposure and heating. An image formation process comprises the steps of subjecting to imagewise exposure the photosensitive material, heating the photosensitive material, electrifying the photosensitive material, and transferring the iamgewise exposed or unexposed portion of the photosensitive material. The photosensitive and heat-developable element comprises a least a photosensitive silver salt and a reducing agent and the polymer has a cross-linked structure.

11 Claims, 1 Drawing Sheet

PHOTOSENSITIVE MATERIAL, AND IMAGE FORMATION PROCESS AND IMAGE FORMATION APPARATUS USING SAME

BACKGROUND OF THE INVENTION

1. Field of the Invention

The present invention relates to the recording of photographic images, and particularly to a photosensitive material capable of forming an image by bringing a photosensitive silver salt to act as a trigger and causing a change in stickiness by a pH value change corresponding to the change of a reducing agent into an oxidized product. It also relates to an image formation process using the photosensitive material, and an image formation apparatus using the same.

2. Related Background Art

An image formation process employing a dry process, utilizing the change of a reducing agent into an oxidized product upon forming a visible image, while bringing a photosensitive silver salt to act as a trigger, is disclosed in Japanese Unexamined Patent Publication No. 62-70836, etc. In such a process, a polymer image is formed by utilizing a difference between a reduced product (an unexposed portion) and an oxidized product (an exposed portion) in the action to inhibit vinyl monomers from being polymerized.

However, the above process of forming a polymer image contains a step of polymerizing vinyl monomers by heating, and hence has had the problems that image formation procedures are complicated and apparatus are made large in size. Moreover, the above process essentially requires the presence of vinyl monomers, but the vinyl monomers can not stay in a stable state in photosensitive materials over a long period of time, thus bringing about the problem that the stability of photosensitive materials is worsened with time.

SUMMARY OF THE INVENTION

An object of the present invention is to provide a photosensitive material that can eliminate the above problems and has been improved particularly in the stability with time, of photosensitive materials and records obtained therefrom.

Another object of the present invention is to provide an image formation process, and an image formation apparatus, that can achieve simplification of image formation procedures and additionally can obtain a sharp image pattern.

The above objects can be achieved by the invention described below.

The present invention provides a photosensitive material comprising a photosensitive and heat-developable element and a polymer, and capable of being endowed with stickiness by a change of pH value.

As another embodiment of the photosensitive material, the present invention also provides a photosensitive material comprising a photosensitive and heat-developable element and a polymer, and capable of being endowed with stickiness by being subjected to exposure and heating.

The present invention also provides an image formation process comprising the steps of;

(a) subjecting to imagewise exposure a photosensitive material containing a photosensitive and heat-developable element and a polymer, and capable of being endowed with stickiness by a change of pH value;

(b) heating said photosensitive material; and (c) transferring an imagewise exposed or unexposed portion of the material to a transferring medium.

As another embodiment of the process, the present invention also provides an image formation process comprising the steps of;

(a) subjecting to imagewise exposure a photosensitive material containing a photosensitive and heat-developable element and a polymer, and capable of being endowed with stickiness by being subjected to exposure and heating;

(b) heating the photosensitive material; and (c) transferring an imagewise exposed or unexposed portion of the material to a transferring medium.

In still another embodiment of the process, the image formation process comprises the steps of;

(a) subjecting a photosensitive material to imagewise exposure;

(b) heating the photosensitive material;

(c) electrifying the photosensitive material; and (d) transferring an imagewise exposed or unexposed portion of the material to a transferring medium.

The present invention further provides an image formation apparatus comprising;

(a) an imagewise exposure means of subjecting a photosensitive material to an imagewise exposure;

(b) a means of heating the photosensitive material; and (c) an electrification means of electrifying said photosensitive material; and (d) a transfer means of transferring an imagewise exposed or unexposed portion of the material to a transferring medium.

DETAILED DESCRIPTION OF THE PREFERRED EMBODIMENTS

Figure 1:
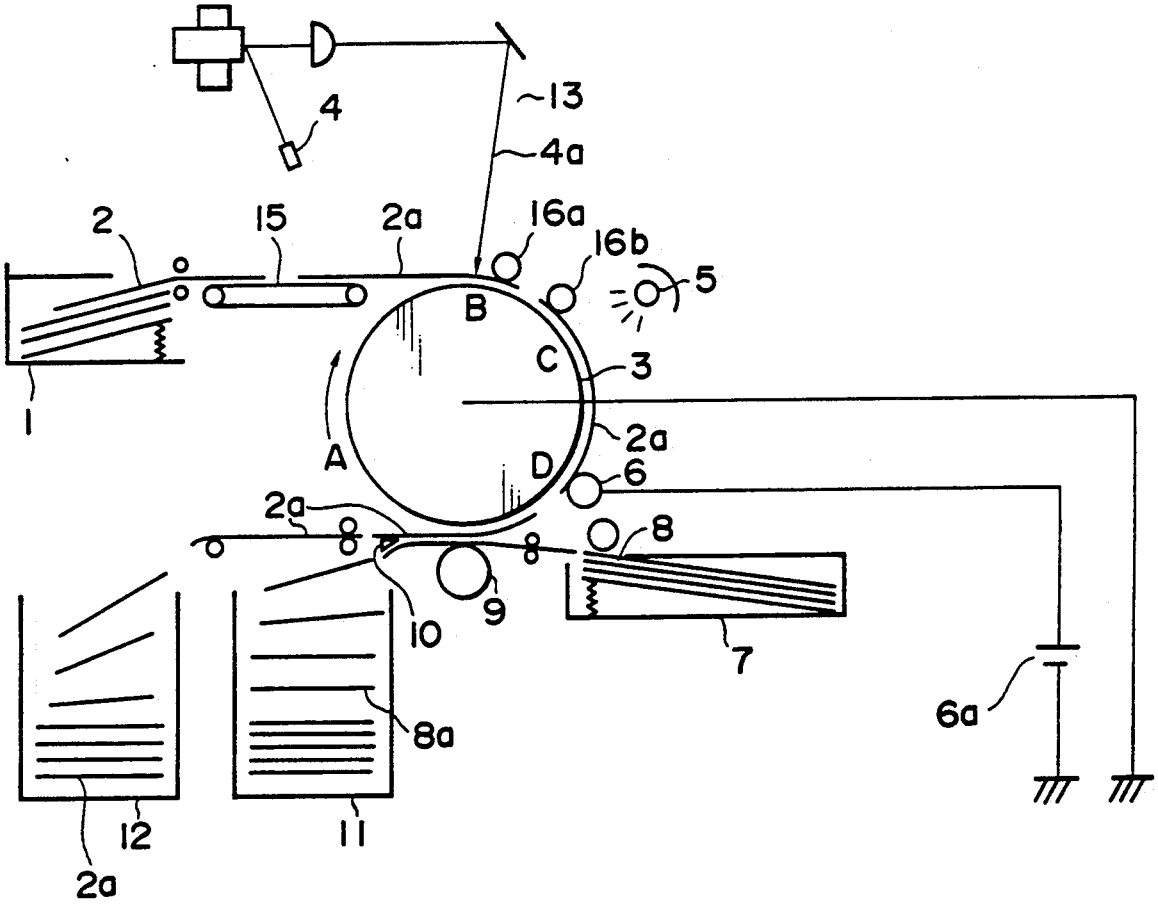
FIG. 1 is a block diagram of the image formation apparatus of the present invention.

The present invention is firstly characterized by a photosensitive material, comprising a photosensitive and heat-developable element and a polymer, and capable of being endowed with stickiness by a change of pH value.

Here, the "photosensitive and heat-developable element" comprises of at least a photosensitive silver salt and a reducing agent, and the element is capable of forming a latent image by imagewise exposure with respect to the photosensitive silver salt and forming a silver image and an oxidized product of the reducing agent by heating in the presence of the reducing agent.

The photosensitive material of the present invention comprises, as essential components, at least the photosenstive silver salt, the reducing agent as mentioned above and the polymer, and is originally a non-sticky photosensitive material, where change in the degree of stickiness is based on the phenomenon that, when a silver image is formed, the pH value changes to an acidic side in an imagewise exposed portion and correspondingly the degree of stickiness of the polymer turns to a higher degree.

For example, in an unexposed state, aluminum foil of 5 cm×5 cm in size and 1 cm in thickness (after precisely weighed) is carefully placed on the image-forming surface of the photosensitive material of the present invention, and is left to stand as it is, under the conditions of a temperature of 25° C. and a humidity of 60% for 1 hour. Thereafter the aluminum foil is carefully peeled, and the peeled aluminum foil is immediately precisely weighed to find a weight increase of the aluminum foil. In the photosensitive material of the present invention, there is preferred such a degree that its solid components are substantially not transferred to the above aluminum foil and the weight increase of the aluminum foil ranges from 0 to about 100 mg (more preferably from 0 to about 10 mg).

In other words, in the photosensitive material of the present invention, what is meant by "non-sticky" (or non-stickiness) is that the weight increase of the aluminum foil ranges from 0 to about 100 mg in the above test, and what is meant by "sticky" (or stickiness) is that the weight increase of the aluminum foil is more than 100 mg in the above test.

If the non-stickiness of the photosensitive material of the present invention is weaker than the above degree, the portion at which a pH value is unchanged, i.e., the imagewise unexposed portion, may be transferred on a transferring medium in such a degree that can not be ignored from a practical viewpoint, resulting in a lowering of image quality. Disadvantages may further arise such that it results in a poor blocking resistance during storage of photosensitive materials.

The photosensitive silver salt used in the photosensitive material of the present invention may include silver halides such as silver chloride, silver bromide, silver iodide, silver chlorobromide, silver chloroiodide, silver iodobromide and silver chloroiodobromide, and organic silver salts such as aliphatic acid silver salts, aromatic carboxylic acid silver salts, and silver salts of the compounds having a mercapto group or thione group. These organic silver salts are silver salts relatively stable to light, but oxidize the contained reducing agent in the presence of a small amount of silver halide, where the organic silver salt itself is reduced to silver. Specific organic salts that can be used include aliphatic acid silver salts such as silver behenate, silver stearate, silver laurate, silver maleate, and silver adipate; aromatic carboxylic acid silver salts such as silver benzoate, silver phthalate, silver terephthalate, and silver salycilate; and silver salts of the compounds having a mercapto group or thione group, such as silver 3-mercapto-4-phenyl-1,2,4-triazole, and silver 2-mercaptobenzoimidazole.

As the reducing agent used in the present invention, known compounds used in the developing of silver halides may be satisfactory. Specifically preferred compounds include 1-phenyl-3-pyrazolidone derivatives, aminophenol derivatives, and polyhydroxybenzene derivatives, and examples of the preferred reducing agents include pyrazolidone derivatives such as 1-phenyl-3-pyrazolidone (phenidone), 4-methyl-1-phenyl-3-pyrazolidone, 4,4-dimethyl-1-phenyl-3-pyrazolidone, 4-ethyl-1-phenyl-3-pyrazolidone, 5-methyl-1-phenyl-3-pyrazolidone, 5-phenyl-3-pyrazolidone, 5,5-dimethyl-1-phenyl-3-pyrazolidone, 4,4-dihydroxymethyl-1-phenyl-3-pyrazolidone, 4-methyl-4-hydroxymethyl-1-phenyl-3-pyrazolidone, 4,5-dimethyl-1-phenyl-3-pyrazolidone, 1-p-methoxyphenyl-3-pyrazolidone, 1-p-tolyl-3-pyrazolidone, and 2-hydroxymethyl-1-phenyl-3-pyrazolidone; aminophenol derivatives such as p(or m or o)-aminophenol, 2,6-dichloro-p-aminophenol, 2,6-dimethyl-p-aminophenol, and 3,5-dimethyl-p-aminophenol; polyhydroxybenzenes or alkoxyphenols such as hydroquinone, methylhydroquinone, catechol, p-tert-butylcatechol, chlorohydroquinone, and p-methoxyphenol; as well as p-anisidine, o-anisidine, o(or m or p)-phenylenediamine, 2,4-tolylenediamine, 3,4-tolylenediamine, and so forth.

Usable as the polymer, which causes a change in the stickiness as described above, corresponding to pH value (i.e., a polymer that changes to have a stickiness of a higher degree, with a change of pH value to an acidic side), are polymers having a cross-linked structure, or electrolytic polymers, or these polymers mixed with or all other polymers mixed with a water-absorbable powder.

Namely, in the above photosensitive material containing any of these polymers and a solvent (a dispersion medium), the change of pH value causes a change or breakage of at least a part of the cross-linked structure of the polymer, bringing (reversibly) its state like a gel into a state like a sol, so that the photosensitive material is endowed on at least its surface or in its inside with the stickiness corresponding to the change of pH value. Alternatively the pH change causes a change of the state of dissociation of the polymeric electrolyte, so that the photosensitive material is endowed with the stickiness corresponding to the pH change.

Also, the change of pH value causes a decrease in the moisture content of a water-containing gel, so that the photosensitive material is endowed with the stickiness. In this occasion, the water-absorbable powder may preferably be contained to obtain a better effect.

The above polymer having a cross-linked structure include those capable of having a cross-linked structure by themselves, or polymers capable of having a cross-linked structure in the presence of a cross-linking agent, and any of which can be used in the present invention. Such a "cross-linked structure" refers to a three-dimensional structure having a "cross-linkage", and the "cross-linkage" is formed by at least one bonding of covalent bonding, ionic bonding, hydrogen bonding, and Van Der Waals' bonding.

Hydrophilic polymers (natural or synthetic) are preferably used as the polymers having the above cross-linked structure.

As such hydrophilic polymers, there are preferably used polymers exemplified by vegetable-derived polymers such as guar gum, locust-bean gum, gum arabic, tragacanth, carrageenan, pectin, mannan, and starch; microorganism-derived polymers such as xanthane gum, dextrin, succinogulcan, and curdran; animal-derived polymers such as gelatin, casein, albumin, and collagen; cellulosic polymers such as methyl cellulose, ethyl cellulose and hydroxyethyl cellulose, or starch-type polymers such as soluble starch, carboxymethyl starch, and methyl starch, alginate polymers such as propylene glycol alginate and salts of alginic acid, and other semisynthetic polymers such as polysaccaride derivatives; vinyl polymers such as polyvinyl alcohol, polyvinyl pyrrolidone, polyvinyl methyl ether, carboxyvinyl polymers, and sodium polyacrylate; and besides synthetic polymers such as polyethylene glycol, ethylene oxide, propylene oxide block copolymers; which can be used alone or optionally in combination of two or more kinds.

Ionically cross-linking agents or covalent-bonding cross-linking agents are used as the cross-linking agent mentioned above, and specific ionically cross-linking agents that are preferably used include various salts such as $CuSO_4$; and boric acid source compounds (or compounds capable of forming borate ions in water), such as borax and boric acid. Employment of these ionically cross-linking agents makes it easy to selectively endow the photosensitive material with the stickiness by the electrochemical reaction (donation and withdrawal of electrons) or the pH change, and therefore is preferable from the viewpoint of suppression of the consumption of a pattern-like energy. These ionically cross-linking agents may preferably be used in an amount of from 0.05 to 3 parts, and more preferably from 0.1 to 1.5 parts, based on 100 parts of a cross-linking substance.

The covalent-bonding cross-linking agents include glyoxal and dialdehydobenzene.

In instances in which the photosensitive material used in the present invention is made to have any desired color and tone, dyes and pigments can be suitably used which are generally used as colorants in the field of printing or recording, or the like fields. These colorants may be dissolved or dispersed in a coating solution. This colorant may preferably be contained in the proportion of from 0.5 to 20% based on the total weight of the photosensitive material.

When a basic component is added for the purpose of adjusting the pH of the coating solution, NaOH, KOH, $Na_2CO_3$, or other strong or weak bases may be appropriately added.

Salts such as NaCl, LiCl and KCl may further be added for the purpose of controlling the conductivity of the coating solution.

Particulate fillers such as silica and carbon black may also be added for the purpose of controlling the viscoelasiticity of the coating solution.

The above polymer may be preferably dispersed in a liquid dispersing medium. It specifically includes water, or, as organic dispersing mediums, hydrophilic dispersing mediums such as N-methylacetamide, N-methylformamide, formamide, ethylene carbonate, acetamide, succinonitrile, dimethyl sulfoxide, sulfolane, glycerol, 1,2-ethanediol (ethylene glycol), furfuryl alcohol, N,N-dimethylacetamide, N,N-dimethylformamide, nitrobenzene, N-methylpyrrolidone, 1,2-propanediol (propylene glycol), diethylene glycol, 2-ethoxyethanol, hexamethylphosphoric triamide, 2-nitropropane, nitroethane, γ-butyrolactone, propylene carbonate, triethylene glycol, 1,2,6-hexanetriol, dipropylene glycol, and hexylene glycol, but, of course, is by no means limited to these.

Among the organic dispersing mediums set out above, polyhydric alcohols (particularly glycols) or derivatives therefrom (ether or ester derivatives, etc.) are preferably used from the viewpoint of the stability of the dispersing medium itself and/or the chemical stability.

These liquid dispersing mediums can be used alone or in combination of two or more kinds, and can be contained in the coating solution in the proportion of from 10 to 90% by weight.

The electrolytic polymer used in another embodiment of the present invention is a polymer that dissociates when dissolved in water, to turn into a polymer ion, and there can be used natural polymers such as alginic acid and gelatin, and polymers synthesized by introducing a dissociating group into a polymer such as polystyrene sulfonic acid or polyacrylic acid. Amphoterically electrolytic polymers such as protein that can dissociate into both an acidic ion and a basic ion can be used as particularly preferred ones.

In the instance where any above polymer is mixed with a water-absorbable powder, used are water absorbable fillers such as silicate-containing minerals including bentonite as exemplified by sodium montmorillonite, calcium montmorillonite or trioctahedral synthetic smectites, and fluorinated mica as exemplified by lithium hectorite, sodium taeniolite, sodium tetrasilicic mica or lithium taeniolite, as well as synthetic mica, and silica.

The photosensitive material used in the present invention may comprise from 0.1 to 20 moles, preferably from 0.5 to 5 moles, of the reducing agent per mole of the photosensitive silver salt, and comprise from 1 g to 1,000 g, preferably from 2 g to 100 g, of the medium containing the polymer capable of causing the change in stickness corresponding to pH value, or the polymer-containing medium and the water-absorbable powder, based on 10 g of the total weight of the photosensitive silver salt and reducing agent. It may also preferably contain 5 mol % or more, preferably 20% or more, of the silver halide as the photosensitive silver salt.

The present invention is secondly characterized by an image formation process comprising;

forming a latent image on the above photosensitive silver salt by applying imagewise exposure to the photosensitive material;

forming an image of a sticky pattern corresponding to an imagewise exposed pattern, by causing the change in stickiness by a change of pH value of the polymer, which pH value changes is caused by the change of the reducing agent into an oxidized product upon developing; and further transferring the image of the sticky pattern on a transferring medium.

The reason why the photosensitive material of the present invention causes its pH change to an acidic side at an imagewise exposed portion is presumed to be attributable to the release of halogen from the silver halide or release of the organic acid from the organic acid silver salt, but it is not the object of the present invention to clarify the mechanism. The pH change may take place by any other factors. For example, the change of pH value may be caused by electrification on the photosensitive material. Alternatively, the pH may be adjusted by adding an alkali-producing agent or an acid-producing agent.

In the process of the present invention, the above electrification may preferably be carried out in combination. Such electrification makes it possible to further enlarge the contrast of the pH difference produced after heating, and also to enlarge the difference in the stickiness of the medium. The electrification brings about such results. Presumably this is because the silver image produced at an imagewise exposed portion enlarges the electrification quantity at the imagewise exposed portion. An auxiliary agent may also be added to more enlarge this difference in electrification quantity that is attributable to the silver image. Carbon black and metal powders such as iron powder and copper powder can be used as such an auxiliary agent.

The electrification made in a large quantity makes reverse the relationship in the pH difference produced after heating, in other words, makes small the pH value at an anode side (or acid side) and makes large the pH value at a cathode side (or alkaline side) when the electrification is made on a conductive image attributalbe to the silver image having been applied with patterning after heating. Namely, the pH on the photosensitive material side can be enlarged even on the part at which the pH value has become small after heating, if the electrification is made between the photosensitive material side as the negative pole and the substrate side as the positive pole.

The present invention is thirdly characterized by an image formation apparatus that bases on the above image formation process.

FIG. 1 is a block diagram of the image formation apparatus of the present invention. In the image formation apparatus illustrated in FIG. 1, once the apparatus is switched on to start, a sheet of photosensitive material 2*a* of photosensitive materials 2 loaded in a photosensitive material box 1 is conveyed along a conveyor belt 15 to a roll 3. The roll 3 is rotating in the direction of arrow A, and the photosensitive material 2*a* conveyed to the roll 3 is wound around the roll 3 and, with that state, held between holder rollers 16*a* and 16*b*, and thus rotationally conveyed. When the photosensitive material 2*a* is positioned at the part B, a laser beam 4*a* oscillated from a laser 4 imagewise irradiates the photosensitive material 2*a* through an optical system 13 such as an optical lens or the like. This results in imagewise forming a latent image on the photosensitive material 2*a*. It is also possible to use a tungsten lamp, a xenon lamp or the like as a light source in place of the laser 4. Subsequently, when the photosensitive material 2*a* is positioned at the part C, it is heat-developed by a heat-developing unit 5. The heat-developing unit 5 can employ an infrared lamp or resistance heater which is non-photosensitive to the photosensitive material 2*a*. Next, when the photosensitive material 2*a* is positioned at the part D, an electrification roll 6 having a conductive surface flows an electric current to the photosensitive material 2*a* through an electric source 6*a*. The current density at this time may preferably be from 1 to 10 mA/mm$^2$. The surface of the roll 3 is formed of a conductive material.

The electrification step mentioned above gives a current-flow in a large quantity through silver particulates formed on the photosensitive material having been subjected to developing, and this application of electric current enables amplification of the polymer stickiness at the imagewise exposed portion to turn it to a higher stickiness.

Next, a recording paper 8 led out from a recording-paper box 7 while being timed with the photosensitive material 2*a* is fed to the nip between the photosensitive material 2*a* on the roll 3 and a pressure roll 9, where the surface of the photosensitive material 2*a* is brought into contact with the surface of the recording paper 8, so that an image is pressure-transferred on the recording paper 8. At the same time, the photosensitive material 2*a* is taken apart from the roll 3, the photosensitive material 2*a* and the recording paper 8 are separated by means of a separating claw 10, and a recording paper 8*a* on which the image has been pressure-transferred is received into a receiving box 11, and the photosensitive material 2*a* having been used, into a receiving box 12.

As a substrate for the photosensitive material used in the present invention, a baryta paper or plastic films such as a polyethylene film and a polyester film can be used, but, when applied in the above electrification step, a plastic film provided on its surface with a metal or alloy film of aluminum, chromium and/or molybdenum, or the metal or alloy film itself of aluminum, chromium and/or molybdenum can be used as the substrate.

The image thus formed can be utilized as a printing plate, and besides can be utilized in a method in which colored particles of toner or ink are adhered on its surface and a method in which coloring matters are previously contained to obtain a color image. In this occasion, an image may be formed on either of the recording paper 8 on which a part of the photosensitive material has been pressure-transferred or the remaining photosensitive material 2*a*.

According to the present invention, it is possible to obtain a photosensitive material having a superior stability with time over a long period, and a record thereof. It also provides an image formation process, and an image formation apparatus, that have been simplified in image formation procedures and additional can form a sharp image pattern.

The present invention will be described below in more detail by giving specific Examples and Reference Examples.

EXAMPLE 1

| | | |
|---|---|---|
| (1) | AgBr-dispersed POVAL solution | 50 g |
| | Make-up: | |
| | AgBr | 5 g |
| | Polyvinyl alcohol | 5 g |
| | Water | 40 g |
| (2) | Silver behenate | 30 g |
| (3) | Hydroquinone | 10 g |
| (4) | Borax ($Na_2.B_4O_7.10H_2O$) | 0.4 g |
| (5) | 1N NaOH | 0.2 g |
| (6) | Ethylene glycol | 20 g |

The above components (1) to (6) were mixed to obtain a gel-like non-sticky photosensitive coating solution.

The above gel was coated on an aluminum plate to give a thickness of 0.5 mm to prepare a photosensitive material. This photosensitive material was loaded in the box 1 of the image formation apparatus illustrated in FIG. 1. A fluorescent lamp of 20 W having a wavelength of 360 nm was used as a light source, to make pattern exposure for 5 seconds. Subsequently, after the photosensitive material was heated for 20 seconds using the heating unit 5 of 120° C., the recording paper 8 was brought to be held between the photosensitive material and the pressure roll 9 to effect pressure-transfer. As a result, formed was an image such that the only light-irradiated portion was transferred from the photosensitive material on the recording paper (the electrification shown in FIG. 1 was omitted).

EXAMPLE 2

| | | |
|---|---|---|
| (1) | AgBr-dispersed POVAL solution | 105 g |
| | Make-up: | |
| | AgBr | 10 g |
| | Polyvinyl alcohol | 15 g |
| | Water | 80 g |
| (2) | Silver behenate | 60 g |
| (3) | Borax ($Na_2.B_4O_7.10H_2O$) | 1.2 g |
| (4) | Hydroquinone | 20 g |
| (5) | 1N NaOH | 0.6 g |
| (6) | Ethylene glycol | 80 g |

The above components (1) to (6) were mixed to obtain a gel-like non-sticky photosensitive coating solution.

The above gel was coated on an aluminum plate to give a thickness of 0.5 mm to prepare a photosensitive material. This photosensitive material was loaded in the box 1 of the image formation apparatus illustrated in FIG. 1. A fluorescent lamp of 20 W having a wavelength of 360 nm was used as a light source, to make pattern exposure for 5 seconds. Subsequently, after the photosensitive material was heated for 20 seconds using the heating unit 5 of 120° C., the photosensitive material was brought to be held between the roll 3 and the electrification roll 6, and electrification was effected for 10 seconds between the roll 3 side as a cathode and the electrification roll 6 side as an anode and at a current density of 3 mA/mm$^2$ and a voltage of 10 V. Next, a plain paper as the recording paper 8 was brought to be held between the photosensitive material and the pressure roll 9 to effect pressure transfer. As a result, obtained was an image such that the only light-irradiated portion was transferred from the photosensitive material on the recording paper 8.

EXAMPLE 3

| | | |
|---|---|---|
| (1) | AgBr-dispersed gelatin solution | 130 g |
| | Make-up: | |
| | AgBr | 10 g |
| | Gelatin | 20 g |
| | Water | 100 g |
| (2) | Water-containing silicate mineral (trade name: Bengel HV; a product by Hojun Yoko Co., Ltd) | 8 g |
| (3) | Silver behenate | 60 g |
| (4) | Hydroquinone | 30 g |

The above components (1) to (4) were mixed under heating and coated to a thickness of 0.1 mm on a platinum plate having a thickness of 0.1 mm to prepare a photosensitive material. This photosensitive material was loaded in the box 1 of the image formation apparatus illustrated in FIG. 1. A fluorescent lamp of 20 W having a wavelength of 360 nm was used as a light source, to make exposure for 5 seconds. Thereafter the photosensitive material was heated for 30 seconds using the heating unit 5 of 120° C. After the heating, the photosensitive material was brought to be held between the roll 3 and the electrification roll 6 made of aluminum, and electrification was effected for 10 seconds between the platinum substrate as an anode and the aluminum roll 3 as a cathode and applying at a voltage of 20 V and a current density of 3 mA/mm$^2$.

Next, a plain paper as the recording paper 8 was brought to be held between the photosensitive material and the pressure roll 9 to effect pressure transfer. As a result, obtained was an image such that the only light-irradiated portion was transferred from the photosensitive material on the recording paper 8.

REFERENCE EXAMPLES 1 TO 3

In regard to the photosensitive materials of the present invention, as described in Examples 1 to 3, tests were carried out to examine the stickiness that depends on the change of pH value.

1N HCl or NaOH was applied to the photosensitive surfaces (100 g) of each of the photosensitive materials of Examples 1 to 3 to give a desired pH value. The pH value was measured by adhering a litmus test paper on the surface of each photosensitive surface of the photosensitive materials.

The tests to examine the stickiness of the photosensitive surfaces before and after the changes of pH value were carried out by, as previously described, placing aluminum foil on the surface of the photosensitive layer, and leaving it to stand as it is, under the conditions of a temperature of 25° C. and a humidity of 60% for 1 hour, followed by peeling of the above aluminum foil, to find the weight increase of the aluminum foil.

TABLE 1

| Ref. Example | Photosensitive material | Before application of HCl or NaOH | | After application of HCl or NaOH | |
|---|---|---|---|---|---|
| | | pH | Weight increase of Al foil (g) | pH | Weight increase of Al foil (g) |
| 1 | Ex. 1 | 8 | 0 (<10 mg) | 2* | 1.5 |
| 2 | Ex. 2 | 9 | 0 (<10 mg) | 2* | 1.4 |
| 3 | Ex. 2 | 5 | 0 (<10 mg) | 9** | 1.1 |

*HCl applied;
**NaOH applied

We claim:

1. An image formation process comprising the steps of:

(a) subjecting a non-adhesive photosensitive material capable of becoming adhesive in response to light exposure and heat development comprising a silver halide, an organic silver salt, a reducing agent and a polymer which is capable of becoming adhesive at room temperature due to pH change, to imagewise exposure to form a latent image;

(b) heating said photosensitive material to promote a change in the pH value of said polymer to form an adhesive pattern of said photosensitive material corresponding to said imagewise exposed pattern;

(c) electrifying said photosensitive material to amplify said change in the pH value; and (d) transferring said adhesive pattern corresponding to said imagewise exposed pattern of said material to a transferring medium.

2. The image formation process according to claim 1, wherein said transfer step has a step of bringing the photosensitive material and transferring medium into pressure contact, and a step of peeling said photosensitive material and transferring medium after the pressure contact.

3. The photosensitive material according to claim 1, wherein said polymer is a polymer having a cross-linked structure.

4. The photosensitive material according to claim 3, wherein said polymer having a cross-linked structure is a hydrophilic polymer.

5. The photosensitive material according to claim 1, wherein said photosensitive material contains a cross-linking agent.

6. The photosensitive material according to claim 5, wherein said cross-linking agent is a boric acid source compound.

7. The photosensitive material according to claim 1, wherein said polymer is an electrolytic polymer.

8. The photosensitive material according to claim 7, wherein said electrolytic polymer is an amphoterically electrolytic polymer.

9. The photosensitive material according to claim 1, wherein said photosensitive material contains a water-absorbable powder.

10. The photosensitive material according to claim 9, wherein said water-absorbable powder is a water-containing silicate mineral.

11. The photosensitive material according to claim 1, wherein said photosensitive material has a conductive substrate.

* * * * *